US006223824B1

(12) United States Patent
Moyes

(10) Patent No.: US 6,223,824 B1
(45) Date of Patent: May 1, 2001

(54) DOWNHOLE APPARATUS

(75) Inventor: Peter Barnes Moyes, Westhill (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/202,632

(22) PCT Filed: Jun. 17, 1997

(86) PCT No.: PCT/GB97/01629

§ 371 Date: Dec. 17, 1998

§ 102(e) Date: Dec. 17, 1998

(87) PCT Pub. No.: WO97/48880

PCT Pub. Date: Dec. 24, 1997

(30) Foreign Application Priority Data

Jun. 17, 1996 (GB) ..... 9612609

(51) Int. Cl.[7] ..... E21B 34/06

(52) U.S. Cl. ..... 166/332.1; 166/319; 166/332.4; 251/63.4

(58) Field of Search ..... 166/319, 321, 166/169, 237, 332.1, 334.1; 225/101, 102, 306; 251/63.4

(56) References Cited

U.S. PATENT DOCUMENTS

| | | | |
|---|---|---|---|
| 3,667,543 | 6/1972 | Dean . | |
| 4,062,406 | 12/1977 | Akkerman et al. . | |
| 4,194,561 | 3/1980 | Erbstoesser et al. . | |
| 4,230,185 | 10/1980 | Fredd . | |
| 4,362,211 | 12/1982 | Fisher, Jr. . | |
| 4,365,671 | 12/1982 | Long . | |
| 4,420,045 | 12/1983 | McMahan . | |
| 4,449,587 | 5/1984 | Rodenberger et al. . | |
| 4,619,320 | 10/1986 | Adnyana et al. . | |
| 4,714,116 | 12/1987 | Brunner . | |
| 4,854,403 | 8/1989 | Ostertag et al. . | |
| 5,240,072 * | 8/1993 | Schultz et al. | 166/169 |
| 5,338,001 | 8/1994 | Godfrey et al. . | |

FOREIGN PATENT DOCUMENTS

| | | |
|---|---|---|
| 0053983 | 6/1982 | (EP) . |
| 0055183 | 6/1982 | (EP) . |
| 0480584 | 4/1992 | (EP) . |
| 0559565 | 9/1993 | (EP) . |
| 2103688 | 2/1983 | (GB) . |
| 2118998 | 11/1983 | (GB) . |
| 2231359 | 11/1990 | (GB) . |
| 93/03255 | 2/1993 | (WO) . |

* cited by examiner

*Primary Examiner*—William Neuder
(74) *Attorney, Agent, or Firm*—Thomason, Moser & Patterson, L.L.P.

(57) ABSTRACT

A downhole ball-valve (20) comprises a body (22) defining a bore (32), a valve ball (34) defining a through passage (36) such that the ball (34) may be positioned to permit flow through the body bore (32) or to close the bore, and a sealing assembly (44) located to one side of the ball and defining a valve seat (50, 53) for forming a sealing contact with the ball (34) and a seal between the body and the assembly. A fluid pressure force applied at one side of the ball (34) tends to urge the valve seat (50, 53) towards the ball (34) and a fluid pressure force applied at the other side of the ball tends to urge the ball towards the valve seat. The sealing assembly forms part of a ball carriage which is axially movable in the bore, axial movement of the carriage inducing rotation of the ball between the open and closed positions.

11 Claims, 14 Drawing Sheets

DOWNHOLE APPARATUS

This invention relates to downhole apparatus and in particular, but not exclusively, to downhole valves and tools for operating downhole valves.

According to the present invention there is provided a downhole ball-valve comprising:

a body defining a bore;

A valve ball defining a through passage such that the ball may be positioned to permit flow through the body bore or to close the bore; and a sealing assembly located to one side of the ball and defining a valve seat for forming a sealing contact with the ball and a seal between the body and the assembly, the arrangement being such that a fluid pressure force applied to said one side of the ball tends to urge the valve seat towards the ball and a fluid pressure force applied at the other side of the ball tends to urge the ball towards the valve seat.

Preferably, the sealing assembly forms part of a ball carriage which is axially movable in the bore, axial movement of the carriage inducing rotation of the ball between the open and closed positions. More preferably, the valve seat remains in sealing contact with the ball over at least a portion of the axial travel of the carriage from the ball-closed position. Further, it is preferred that the seal between the sealing assembly and the body is maintained over said travel.

Preferably also, the ball carriage is biassed towards the ball-open position.

Preferably also, a latch assembly is provided between the body and the ball carriage for releasably retaining the ball carriage in the ball-closed position. The latch assembly may include a latch member connected to the ball carriage and provided with radially extendable portions and a support member for supporting said portions in an extended position in engagement with a profile defined by the body, whereby movement of the support member from a support position permits said portions to retract and the latch member to move relative to the body and the ball to open. Most preferably, the retracted portions of the latch member engage the support member such that axial movement of the support member results in corresponding movement of the latch member. In one embodiment lifting the support member causes the latch member and ball carriage to move to the ball-closed position and on reaching this position the latch engages to retain the ball carriage in the ball-closed position. Most preferably, means are provided for retaining the support member in the support position. Said means may be in the form of a ratchet between the support member and a portion of the body.

Preferably also, the ball carriage includes means for engaging a downhole tool located in the bore to permit the tool to move the ball carriage from the ball-open position to the ball-closed position. In the preferred embodiment said means is in the form of the support member of the latch assembly.

The ball carriage may be moveable from the ball-closed position to the ball-open position by application of one or both of fluid pressure or physical force. In a fluid pressure actuated embodiment, application of pressure to a selected portion of the valve results in movement of the support member from the support position. In the preferred embodiment a ratchet and spring arrangement translates movement of a piston in one direction into movement of the support member in the opposite direction. The piston may be moveable in response to bore pressure.

According to another aspect of the invention there is provided a downhole tool comprising:

a body defining a chamber;

a piston axially movable in the chamber in a first direction from a first position in response to an applied fluid pressure force;

a member movable in an opposite second direction;

a ratchet assembly between the piston and the member and permitting movement of the piston in said first direction without corresponding movement of the member, and coupling the piston to the member when the piston is moved in said second direction; and means for biasing the piston in said second direction towards said first position, whereby movement of the piston in the first direction may be translated to corresponding movement of the member in the second direction.

A further ratchet assembly may be provided for conserving movement of the member in the second direction.

According to a further aspect of the invention there is provided a downhole tool comprising:

a body;

a first member axially movable relative to the body in a first direction from a first position in response to an applied force;

a second member moveable in an opposite second direction;

a ratchet assembly between the members and permitting movement of the first member in said first direction without corresponding movement of the second member, and coupling the first member to the second member when the first member is moved in said second direction; and means for biassing the first member in said second direction towards said first position, whereby movement of the piston in the first direction may be translated to corresponding movement of the member in the second direction.

These aspects of the present invention permit a fluid pressure force or physical force applied in a first direction to be translated into movement in an opposite second direction. Thus, for example, a tensile upward force applied from the surface via wireline may be translated to a downward force.

According to a still further aspect of the present invention there is provided a downhole tool comprising a latch assembly for retaining a first member relative to a second member, the first member including a keying portion for engagement with a locking profile of the second member, the profile defining a stop shoulder, the tool including biassing means for normally lifting the keying portion off the shoulder and whereby application of a predetermined force to the first member brings the keying portion into locking contact with the shoulder.

This aspect of the present invention is useful in preventing jamming or seizing of downhole tools; if there is no force being applied to the first member the keying portion is held off the shoulder, making it less likely that the keyboard portion will jam or lock when it is desired to release the keying portion from the profile.

According to a yet further aspect of the present invention there is provided a downhole tool including a radially movable first portion linked to an axially movable second portion, whereby movement of the tool between sections or bore of different diameters moves or permits movement of the first portion to produce axial movement of the second portion.

In use, this aspect of the present invention allows, for example, tools to be set downhole simply by passing the tool through a bore restriction, such as the transition between the bore casing and liner.

These and other aspects of the present invention will now be described, by way of example, with reference to the accompanying drawings, in which.

Figure 1:
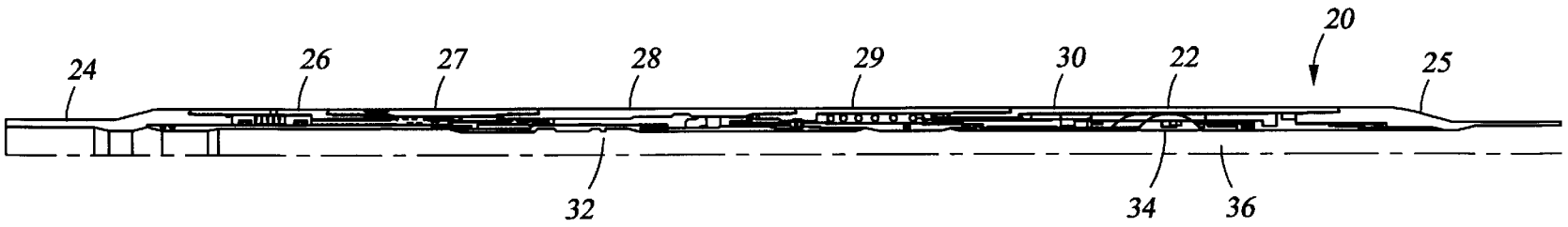
FIG. 1 is a view of a half-section of a downhole valve in accordance with a first embodiment of the present invention.

Reference is first made to FIGS. 1 and 2 of the drawings, which illustrate a downhole valve 20 in accordance with a first embodiment of the present invention. The valve may be used in a number of different applications, but will be described below with reference to applications in completion testing in which the valve may be closed to permit pressure tests to be carried out above the valve, and then opened to permit unobstructed flow through the valve.

The valve 20 includes a tubular body 22 comprising upper and lower end sleeves 24, 25 and five outer sleeve portions 26, 27, 28, 29 and 30 connected to one another and also to the end sleeves 24, 25 by appropriate threaded connections. The body 22 defines a throughbore 32 and located towards the lower end of the bore 32 is a valve ball 34 defining a through passage 36 such that the ball 34 may be rotated between an open position (as illustrated) in which the ball passage 36 is aligned with the bore 32, and a closed portion in which the passage is perpendicular to the bore. Rotation of the ball 34 is achieved by relative axial movement between two pairs of side plates 38, 39, one plate 38 carrying a spigot 40 engaging a bore 41 in the side of the ball 34 on the ball central axis, and the other plate 39 carrying an offset spigot 42 engaging a corresponding offset bore 43 on the ball 34.

The ball 34 and side plates 38, 39 from part of a ball carriage assembly which is axially movable relative to the body 22, and includes a sealing assembly 44. Although the closed valve 20 presents a barrier to flow in both directions, the sealing assembly is provided only on the lower side of the ball 34. The assembly 44 includes a sleeve 46 which is axially movable relative to the body 22 and includes a chevron seal 48 between its lower end and the lower end sleeve 25. The upper end of the sleeve 46 defines a step 49 which accommodates a valve seat sleeve 50 including chevron and O-ring seals 51, 52 and an annular sealing face 53 for contact with the ball 34. The sleeve 50 is biassed into contact with the ball 34 by a compression spring 54.

On the opposite side of the ball 34 a ball protecting sleeve 56 is biassed, by compression spring 57, into contact with the upper surface of the ball 34.

The side plate 39 is capable of limited axial movement and is coupled to the upper end of the outer sleeve portion 30. However, the other side plate 38 is movable over the greater distance, and as mentioned above this differential axial movement of the plates 38, 39 is utilised to rotate the ball 34. The side plate 38 is connected to a sleeve 58, the upper end of the sleeve 58 providing a stop for a ring 59 against which a compression spring 60 acts. The upper end of the spring 60 abuts a further ring 61 which engages a shoulder 62 formed on the outer sleeve portion 29. The spring 60 tends to push the sleeve 58 and the side plate 38 downwardly, and thus maintains the ball 34 in the open position.

The upper end of the sleeve 58 is threaded and pinned to an inner sleeve 64, the lower end of the sleeve 64 defining a housing for the spring 60 and the upper end of the sleeve 64, defining spring fingers 66, being threaded and pinned to a latch sleeve 68. Keys 69 are provided in circumferentially spaced apertures 70 defined by the sleeve 68. The keys 69 are located radially between the outer sleeve portion 28 and an inner support sleeve 72. As shown in FIGS. 1 and 2, the keys 69 are retracted and the lower inner corner of each key 69 engages a shoulder 73 defined by the sleeve 72. However, it will be noted that the outer sleeve portion 28 defines a profile 74 into which the keys 69 may extend, to lock the latch sleeve 68 relative to the body 22, as will be described. The upper part of the support sleeve 72 defines a no-go 75 and a profile 76 for engaging a setting tool, as will be described. Initially, the support sleeve 72 is movable upwardly relative to the body 22 and a ratchet sleeve 78 provided between the sleeve 72 and the outer sleeve portion 27. As will be described, such movement may take place until the support sleeve shoulder 80 engages an opposing ratchet sleeve shoulder 81. Further, the support sleeve 72 may be maintained in this position relative to the ratchet sleeve 78 by engagement of a ratchet 82 with a toothed profile 83 formed on the outer surface of the support sleeve 72.

The upper end of the ratchet sleeve 78 is threaded and pinned to a further inner sleeve 85 which extends into the upper end sleeve 24. The upper end of the sleeves 85 co-operates with a further ratchet assembly 85, this assembly including a lower first ratchet set 87 arranged to be movable relative to the sleeve 85, and an upper ratchet set 88 which prevents upward movement of the sleeve 85 relative to the body 22. A bellville spring stack 90 is provided between the ratchets 87, 88. The lower face of the ratchet 87 abuts the upper end of a piston sleeve 92. The lower face of the piston sleeve 92 is in fluid communication with the body bore whereas the piston upper face 94 is in communication with the exterior of the body 22. Thus, a positive differential pressure across the body will tend to push the piston sleeve 92 upwardly and thus lift the lower ratchet 87 relative to the inner sleeve 85. The upward movement of the piston sleeve 92 relative to the body 22 is controlled by a ring 96 on the upper portion of the sleeve 92, and the axial extent of which may be adjusted through body port 98. It will be seen that upward movement of the piston sleeve 92 will cause the lower ratchet 87 to move upwardly over the toothed portion of the sleeve 85. When pressure is bled off from the bore, the spring stack 90 will act on the lower ratchet 87 and thus move the sleeve 85 downwardly. This downward movement is conserved by the upper ratchet 88. Thus, application of a number of pressure cycles to the body bore will result in step-wise downward movement of the sleeve 85, as used in opening the closed valve, as will be described.

In use, the valve 20 will be run into a borehole in the open position, as illustrated. If it is desired to close the valve, a suitable setting tool is run downhole to engage the support sleeve profile 76. The sleeve 72 is then pulled upwardly such that the support sleeve shoulder 73 engages the key 69 and lifts the latch sleeve 68 and the inner sleeve 64, the spring fingers 66 being deflected inwardly to clear a shoulder 67 defined by the outer sleeve portion 29. Such upward movement also lifts the connecting sleeve and the side plate 38. As the side plate 39 including the offset spigot 32 is restrained from substantial axial movement, such movement of the side plate 38 results in the ball 34 moving upwardly and rotating to the closed position. As the lower end of the side plate 36 is coupled to the sealing assembly sleeve 46, the sealing assembly 44 is lifted with the ball 34. As the latch sleeve 68 moves upwardly with the support sleeve 72, the keys 69 will be pushed outwardly into the profile 74, locking the latch sleeve 68 relative to the body but allowing further upward movement of the support sleeve 72. This upward movement may continue until the support sleeve shoulder engages the ratchet sleeve shoulder 81. The sleeve 78 is held in this position by engagement of the ratchet 82 with the toothed profile 83. The ball 32 is thus locked in the closed position.

To open the valve, the bore pressure is increased to produce upward movement of the piston sleeve 92 relative to the body 22. As described above, the results in upward movement of the lower ratchet 87 relative to the inner sleeve 85, and when pressure is bled off the energy stored in the ratchet spring moves the inner sleeve 85 downwardly relative to the body 22 by the same distance. The axial extent of the ring 96 is determined such that the valve 20 may be subject to a predetermined number of pressure cycles before the support sleeve 72 has move downwards relative to the body 22 sufficiently to allow the keys 69 to move inwardly, thus releasing the latch sleeve 68 from the body 22 and allowing the spring 60 to move the sleeve 58 downwardly and thus rotate the ball 34 to the open position.

Reference is now made to FIGS. 3, 4, 5, 6, 7 and 8 of the drawings, which illustrate a setting tool 110 for use in setting the valve 20 described above, and in particular for use in moving the ball 34 from the initial open position to a closed position. The tool 110 comprises an elongate body 112 formed of a number of outer sleeve portions. The body upper end 114 is adapted to be connected to wireline, coil tubing and the like. Positioned within the body 112 is a mandrel 116 which is biassed upwardly relative to the body 112 by a compression spring 118. However, the mandrel 116 is initially restrained in a lower position by the engagement of spring fingers 120 at the lower end of the mandrel 116 with a shoulder 122 on the body 112 (see FIG. 3). The spring fingers 120 are held in engagement with the shoulder 122 by a plug 124 located within a lower end sleeve 126, the plug 124 being held in position relative to the sleeve 126 by a shear pin 132. A port 120 is provided through the lower end of the sleeve 126, but is initially sealed by a resilient plug (not shown). Thus, the plug 124 and end sleeve 126 define an atmospheric chamber 130.

Figure 4A:
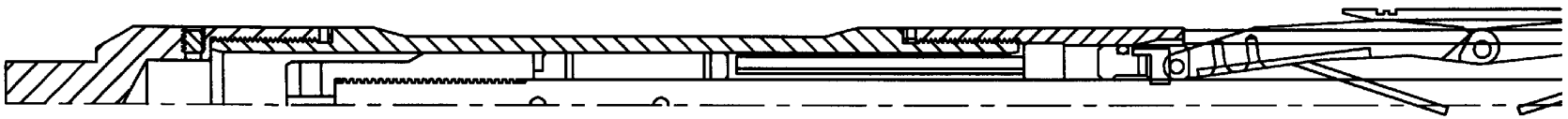
Figure 5A:
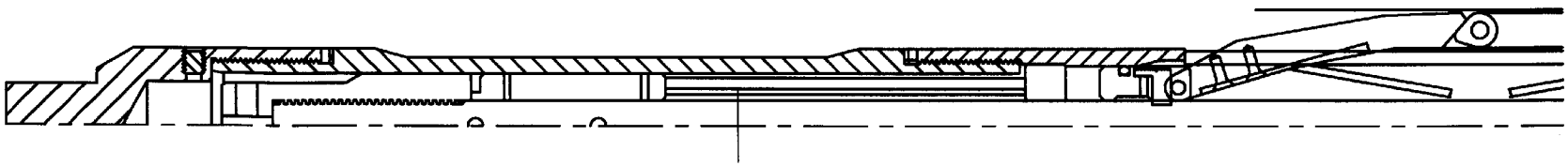
Figure 3B:
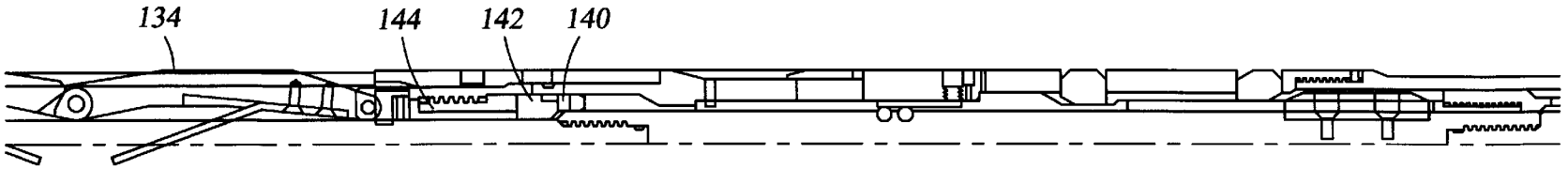
Figure 4B:
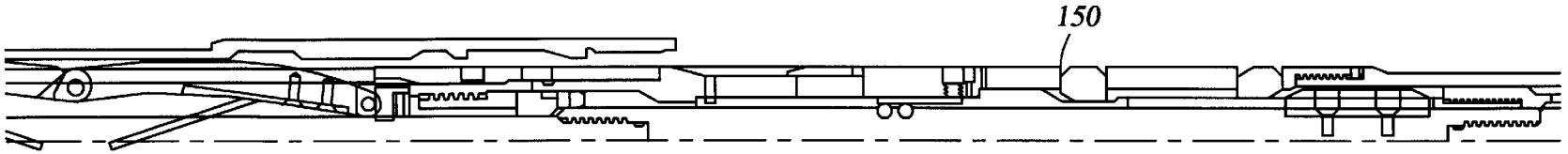
Figure 5B:
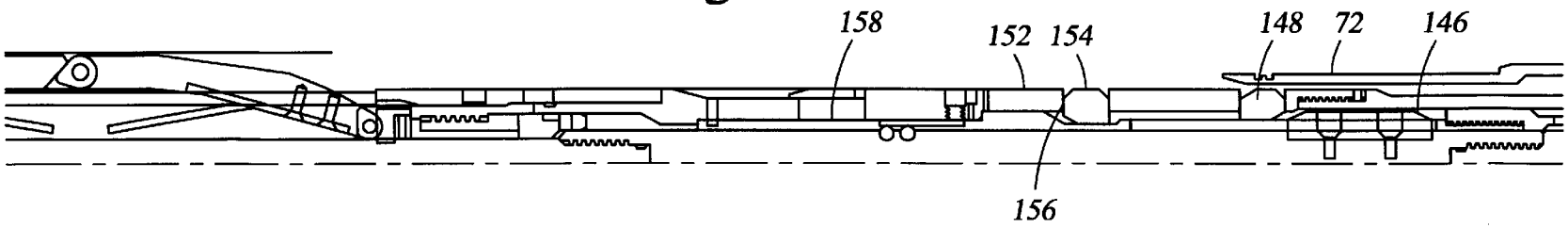
Figure 3C:
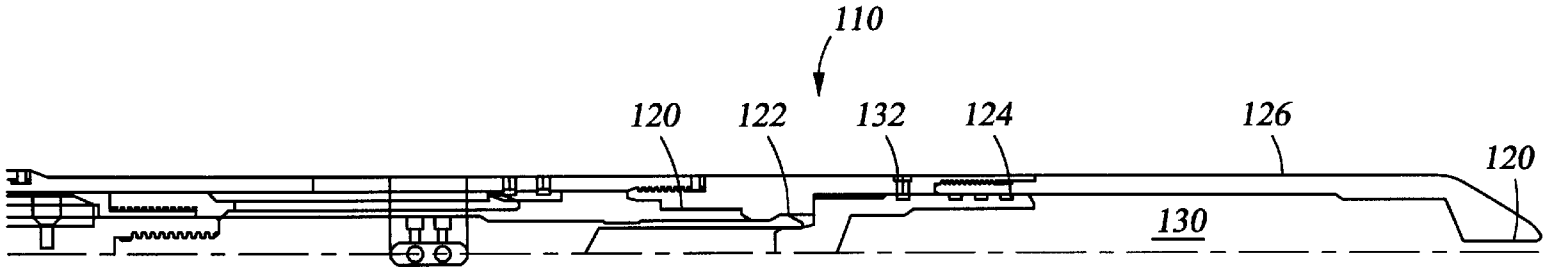
Figure 4C:
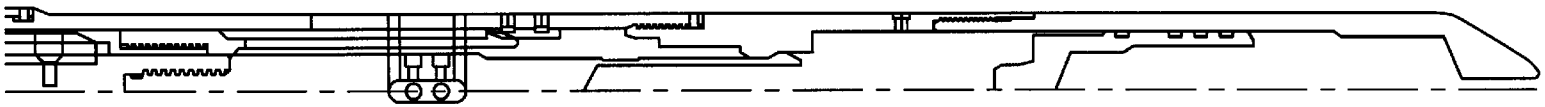
Figure 5C:
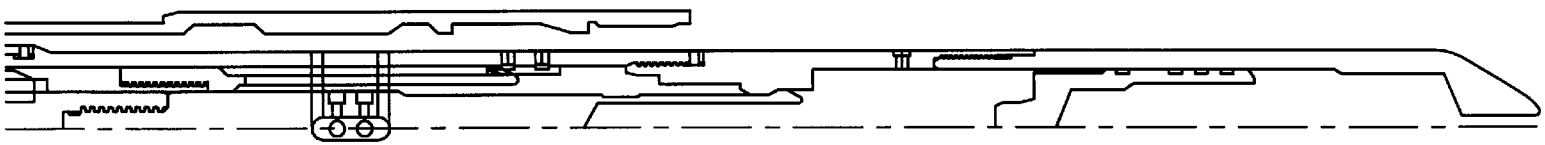
Figure 6A:
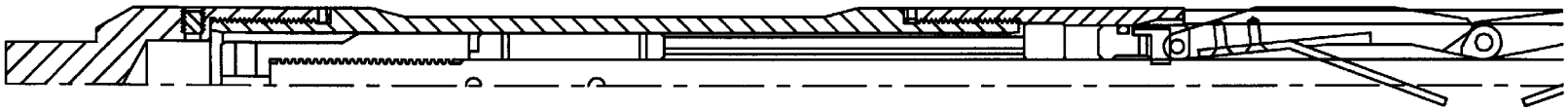
Figure 7A:
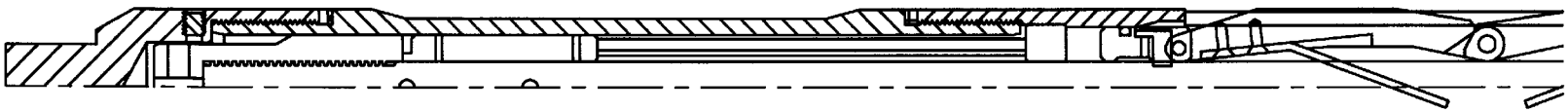
Figure 8A:
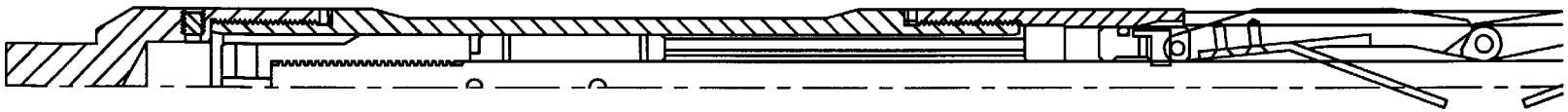
Figure 6B:
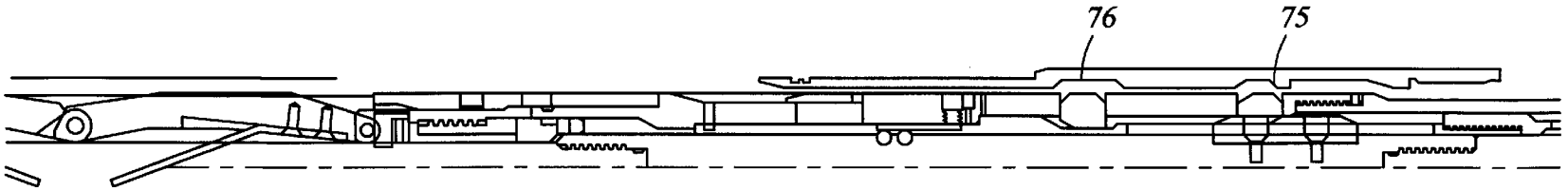
Figure 7B:
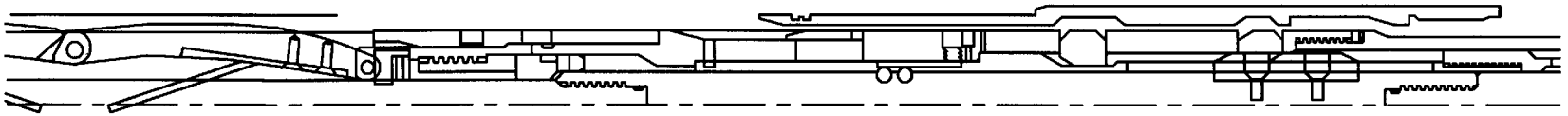
Figure 8B:
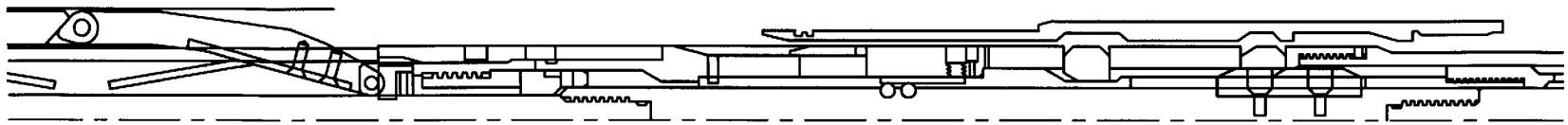
Figure 6C:
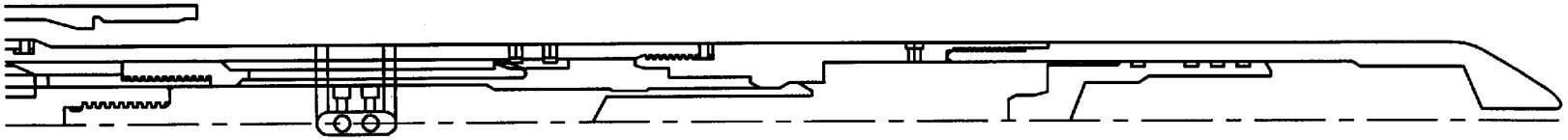
Figure 7C:
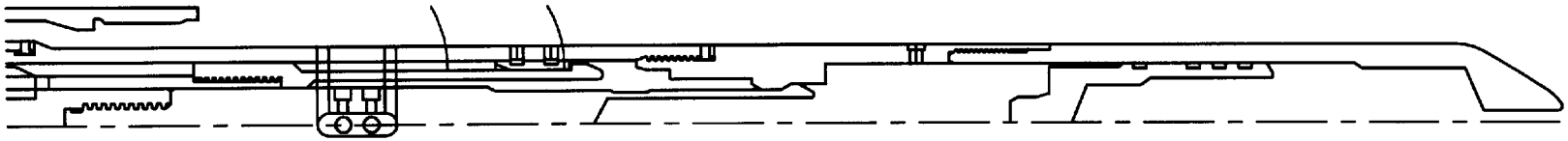
Figure 8C:
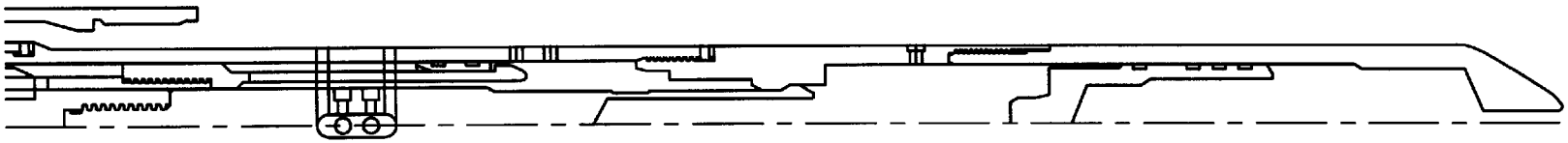

As the tool 110 is run downhole, the elevated pressure within the bore acts upon the upper surface of the plug 124. The pin 132 is selected to shear at a pressure which corresponds to a predetermined depth, at which the tool 110 is located in the valve 20 in a section of liner, below a larger diameter section of casing. On reaching this depth, the plug 124 is forced downwardly to shear the pin 132 and the plug closing the port 128 is burst, such that the plug 124 moves downwardly in the chamber 130 (FIG. 4). This movement frees the spring fingers 120 such that the mandrel 116 is free to move upwardly relative to the body 112. However, the tool 110 is arranged such that such movement only becomes possible once the setting tool 110 has been withdrawn from the valve 20, and indeed a part of the valve support sleeve 72 is illustrated in FIG. 4.

A set of circumferentially spaced spring fingers 134 is provided between the body 112 and the mandrel 116, with springs 136 tending to extend the fingers 134 radially through windows 138 in the body 112. A shoulder 140 on the mandrel 116 bears against keys 142 which in turn bear against a sleeve 144 coupled to the lower end of the fingers 134. Thus, on the fingers 120 being released, the mandrel 116 may only move upwardly until the shoulder 140 engates the keys 142, the restricted diameter within the liner and valve 20 preventing the fingers 134 from moving outwardly to accommodate upward movement of the mandrel 116 (see FIG. 5).

If, however, the tool 110 is lifted above the valve 20 and out of the liner in which the valve 20 is located and into the larger diameter casing above the liner, the fingers 134 are free to move outwardly, allowing the keys 142 to move upwardly and outwardly, and thus allowing the mandrel 116 to move upwardly relatively to the body 112.

A ramp member 146 is fixed to the mandrel 116 and with the upward movement of the mandrel relative to the body 112 the member 146 is moved beneath no-go keys 148 located in an aperture 150 in an outer sleeve 152 forming part of the tool body. A set of profile engaging keys 154 are provided upwardly of the keys 148 and are positioned in respective apertures 156 in the sleeve 152. The keys 154 are supported by an intermediate support sleeve 158.

The tool 110 is then lowered into the valve 20 once more, until the no-go keys 148 engage the no-go 75 defined by the valve support sleeve 72. Continued downward movement of the tool 110 results in upward movement of the outer sleeve 152 relative to the intermediate support sleeve 158, such that the keys 154 are pushed outwardly into contact with the support sleeve profile 76. This positioning of the support sleeve 158 relative to the outer sleeve 152 is maintained by latch fingers 160 on the lower end of the sleeve 158 engaging a shear collar 162 on a lower portion of the outer sleeve 152.

When the tool 110 is lifted the keys 154 engage the latch sleeve profile 76 and lift the ball 34 to the closed position. Continuing to pull the setting tool 110 upwards causes the shear collar 162 to detach from the outer sleeve 152 such that the sleeve 156 may be pulled upwardly relative to the outer sleeve 152 and the keys 154 retracted, allowing the tool 110 to be pulled clear of the valve 20.

Figure 9:
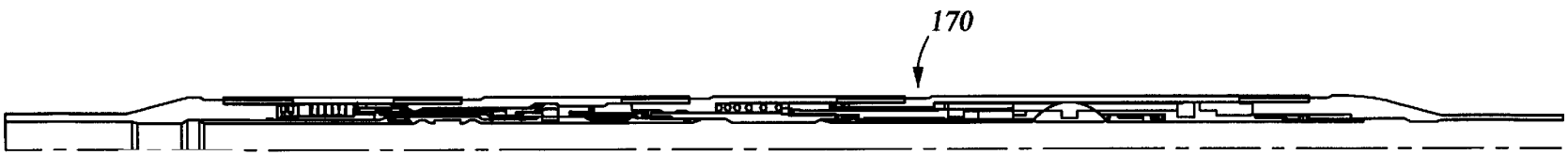
FIG. 9 is a view of a half-section of a downhole valve in accordance with a further embodiment of the present invention.
Figure 2A:
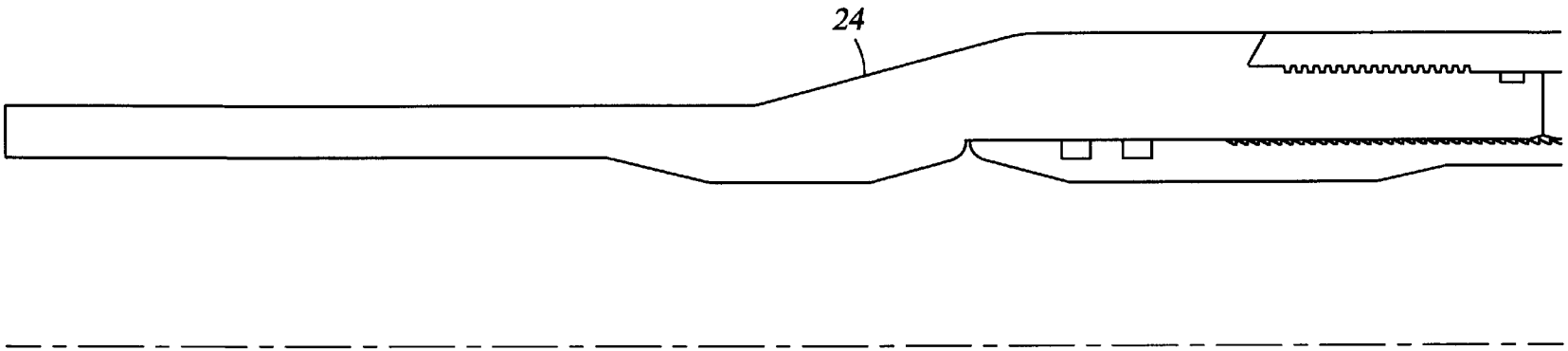
FIG. 2 is an enlarged view of the downhole valve of FIG. 1 (on seven sheets)
Figure 10A:
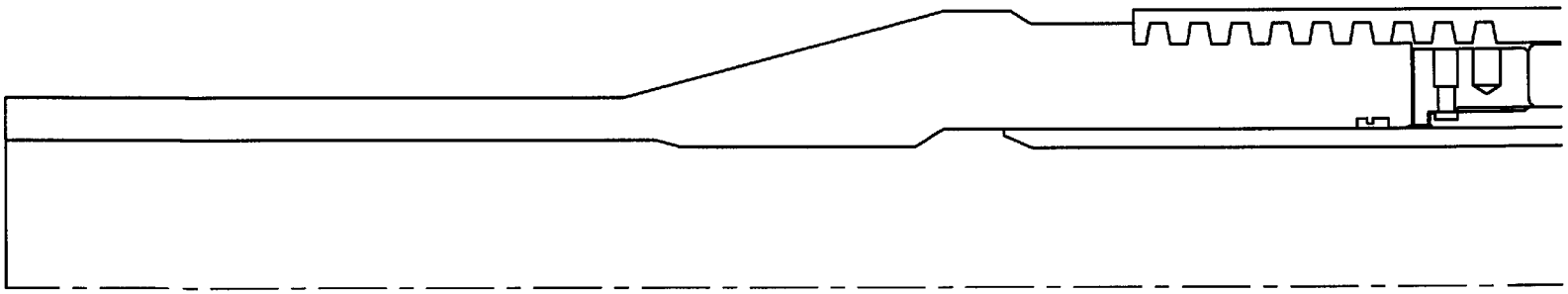
FIG. 10 is an enlarged view of the valve of FIG. 9 (on six sheets).
Figure 2B:
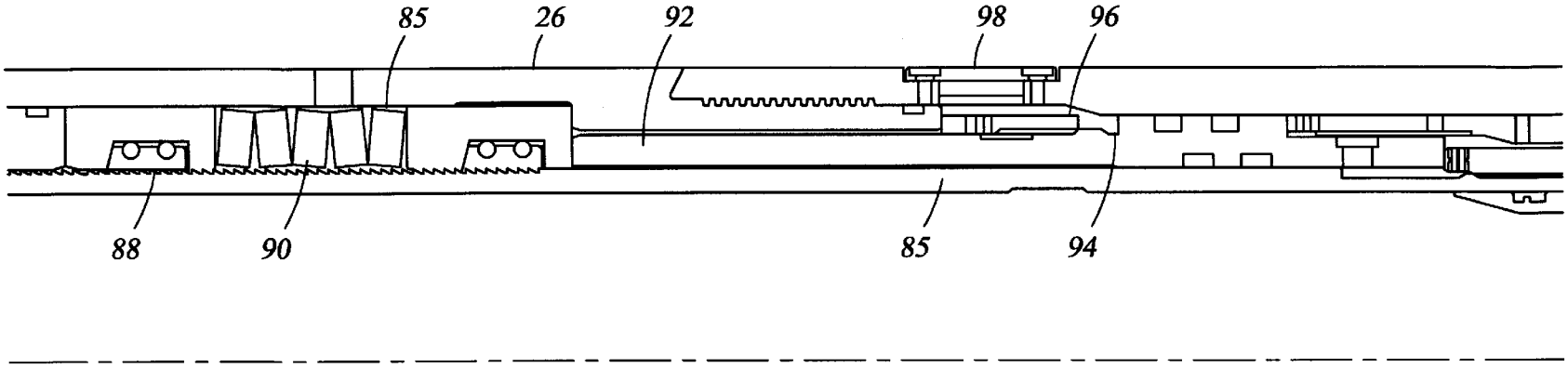
Figure 10B:
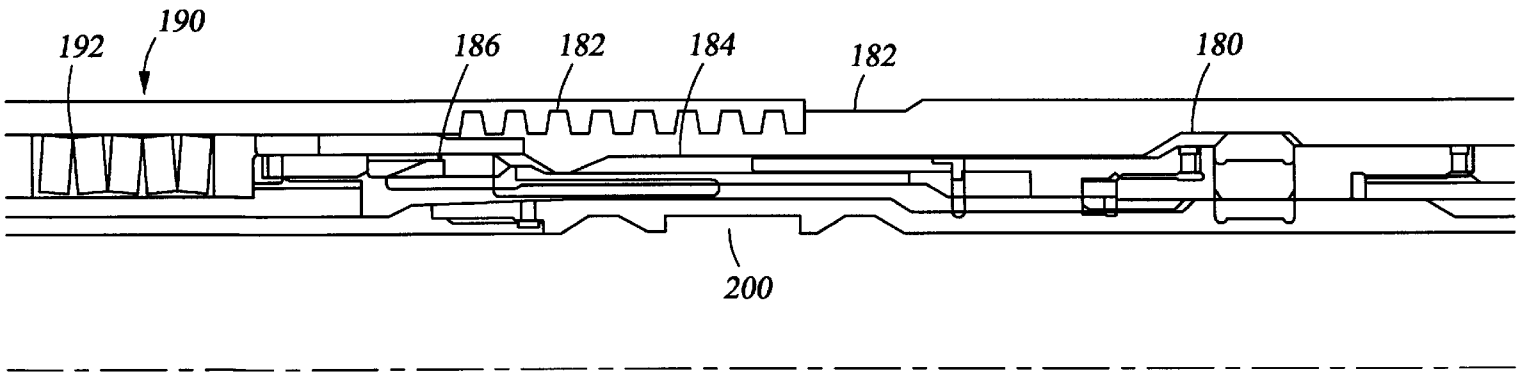
Figure 2C:
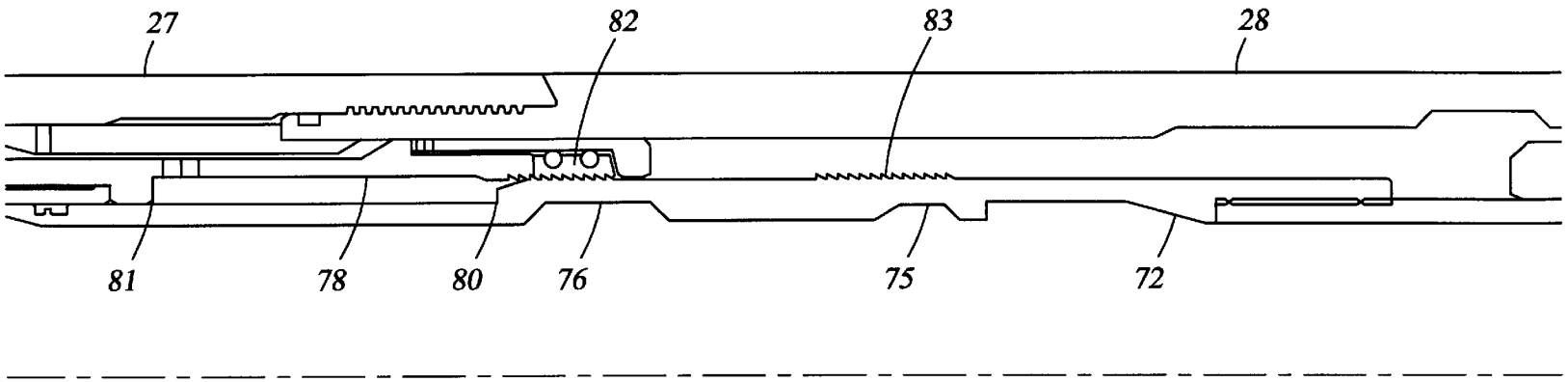
Figure 10C:
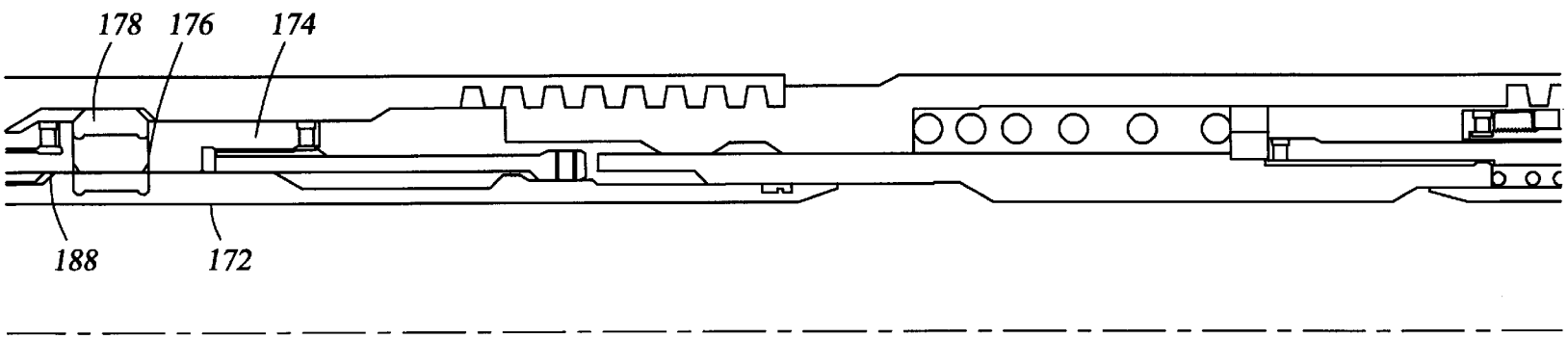
Figure 2D:
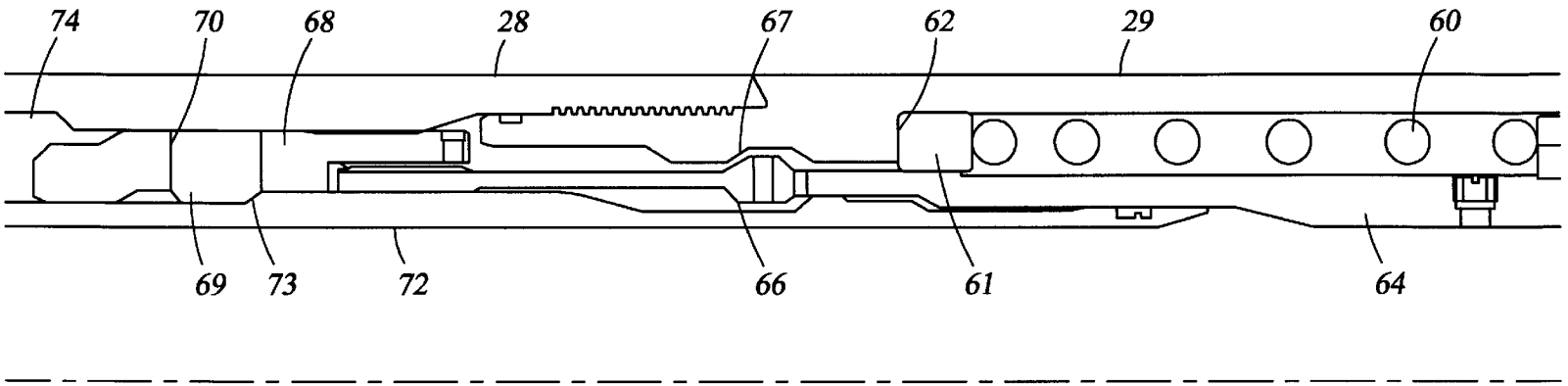
Figure 10D:
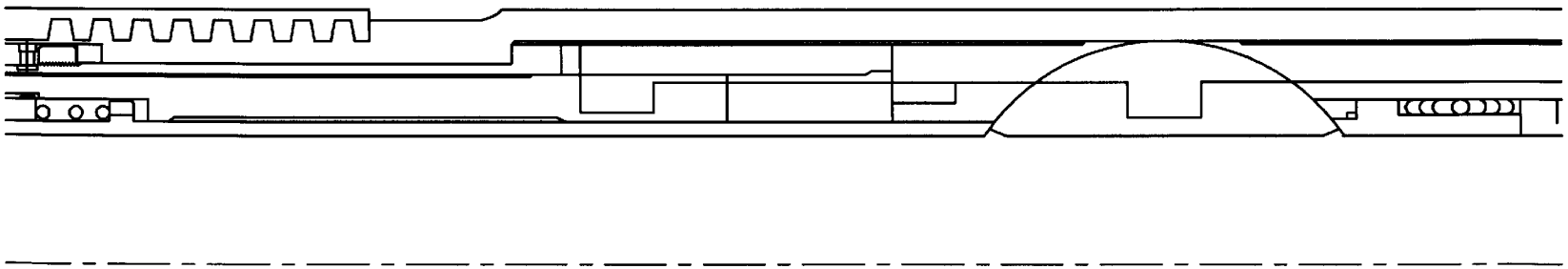
Figure 2E:
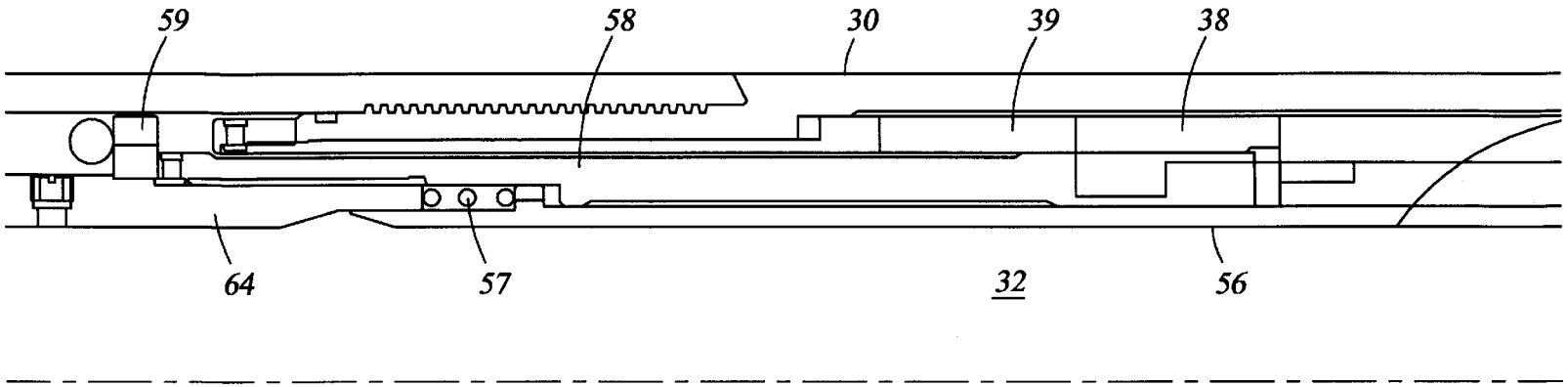
Figure 10E:
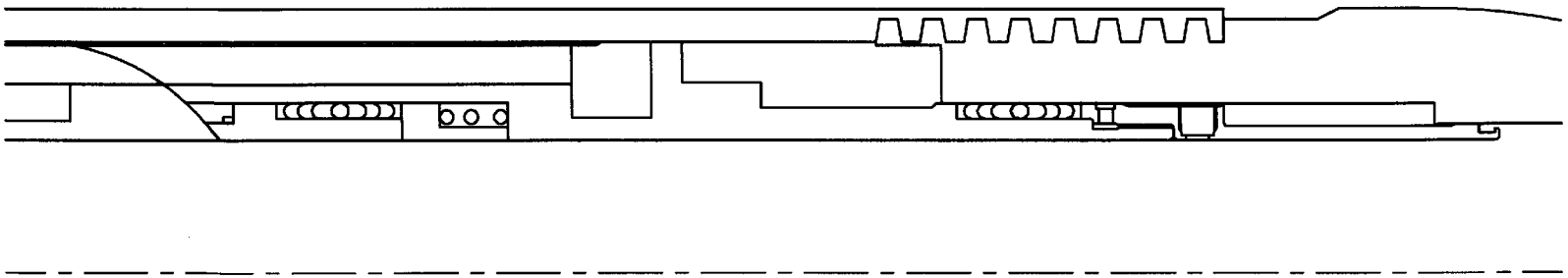
Figure 2F:
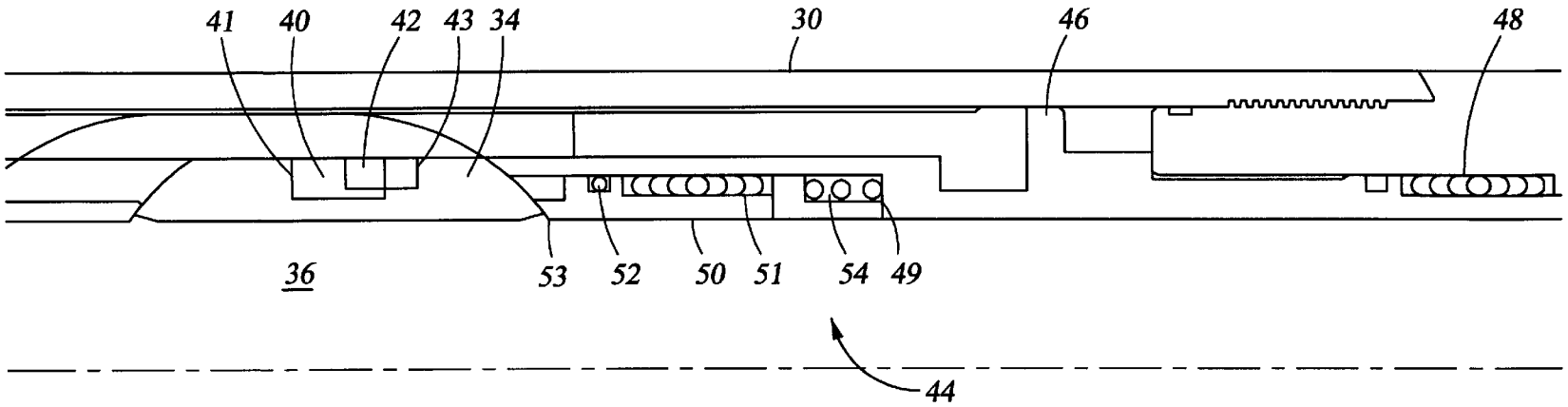
Figure 10F:
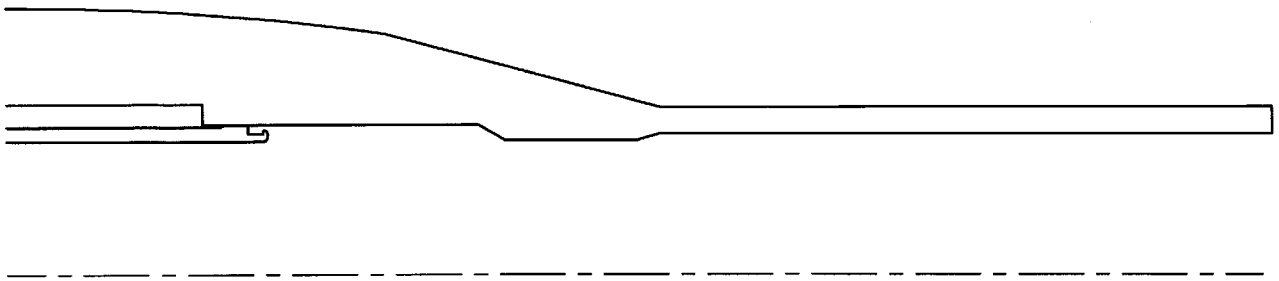
Figure 2G:
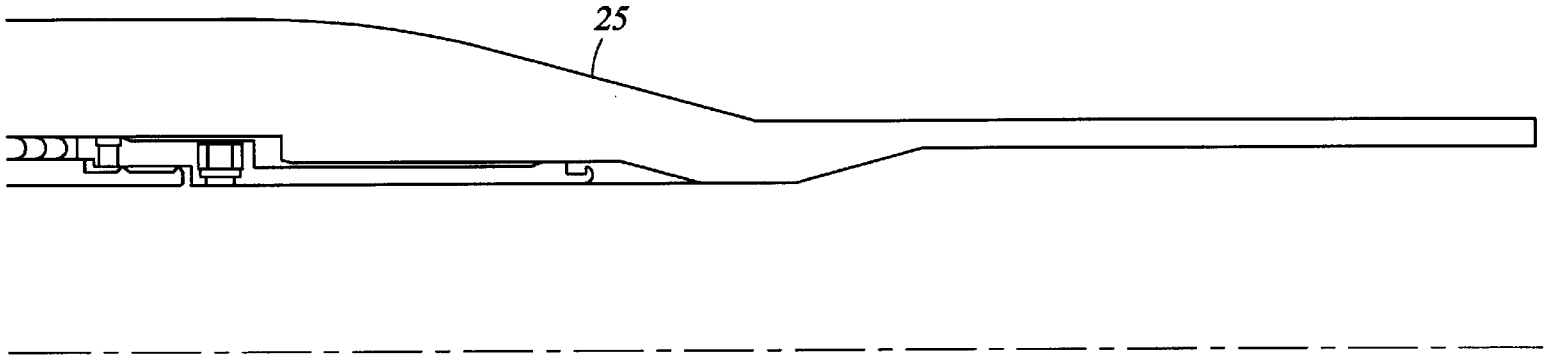
Figure 3A:
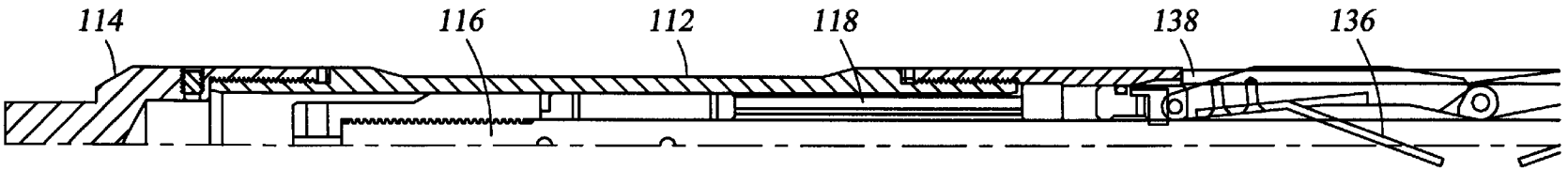
FIGS. 3 through 8 are sectional half-sections of a shifting tool in accordance with a further embodiment of the present invention and which may be used in setting the valve of FIG. 1 (on three sides)

Reference is now made to FIGS. 9 and 10 of the drawings, which illustrate a valve 170 in accordance with a further embodiment of the present invention. The valve 170 is suited for use as, for example, a lubricator valve. The valve 170 shakes many features with the valve 20 described above, but is solely mechanically operated by an appropriate setting tool. The configuration of the lower part of the valve 170 is substantially similar to the valve 20, and therefore will not be described again in any detail. However, the key support sleeve 172 and the latch sleeve 174 are of different configuration, as described below. The latch sleeve 174 defines a number of circumferentially spaced apertures 176 which accommodate keys 178. As shown in the drawings, when the valve 170 is open the keys 178 are retracted and spaced downwardly from the key engaging profile 180 in the valve body 182. The support sleeve 172 defines a shoulder 188 that may be brought into engagement with the key 178 to lift the latch sleeve 174, as will be described. Attached to the upper end of the latch sleeve 174 are a set of spring teeth 184 which, as will be described, may be lifted upwardly to engage a ledge 186 and assist in holding the valve in the closed position.

The tooth engaging ledge 186 is coupled to the valve body 182 via a spring assembly 190, and application of downward force to the ledge 186 tends to compress a bellville spring stack 192 within the assembly 190.

To move the valve from the open position to the closed position, a setting tool is run into the valve 170 and engages the tool-engaging profile 200 defined by the support sleeve 172. If the support sleeve 172 is then lifted upwardly, the shoulder 188 will contact the keys 178 and thus lift the latch sleeve 174, and the valve ball assembly, upwardly to move the ball to the closed position. The keys 178 move outwardly into the body profile 180 to lock the latch sleeve 174 relative to the body 182. Further, the sprung teeth 184 engage the ledge 186.

The spring assembly 190 is arranged to lift the teeth 184 and the latch sleeve 174, via the ledge 186, such that the keys 178 are lifted off the shoulder of the profile 180. Thus, when there is no substantial pressure differential across the closed ball, the valve ball will be maintained in the closed position by the engagement of the teeth 184 with the ledge 186. This prevents the keys 178 being continually forced inwardly into contact with the support sleeve 172, which in certain circumstances may result in jamming of the valve. However, if a substantial differential pressure is applied to the ball the spring stack 192 is compressed to bring the keys 178 into locking contact with the profile shoulder.

To open the valve, the support sleeve 172 is moved downwardly using setting tool. The teeth 184 are lifted clear of the ledge 186 by contact with a ramp 194 and the keys 178 move inwardly, allowing the latch sleeve 174 to move downwardly and open the ball.

it will be clear to those of skill in the art that the above-described embodiments are merely exemplary of the present invention, and that various modifications and improvements may be made thereto without departing from the scope of the invention.

What is claimed is:

1. A downhole tool comprising:

a body defining a chamber;

a piston axially moveable in the chamber in a first direction from a first position in response to an applied fluid force;

a member moveable in an opposite second direction;

a ratchet assembly between the piston and the member permitting movement of the piston in said first direction without corresponding movement of the member in the first direction, and coupling the piston to the member when the piston is moved in said second direction; and means for biasing the piston in said second direction towards said first position movement of the piston in the first direction being translatable to subsequent corresponding movement of the member in the second direction.

2. The tool of claim 1, wherein a further ratchet assembly is provided for conserving movement of the member in the second direction.

3. The downhole tool of claim 1 wherein said member operates a valve within said downhole tool.

4. The downhole tool of claim 3 wherein said valve is a ball-valve comprising:

a body defining a bore;

a valve ball defining a through passage such that the ball may be oriented to an open position to permit flow through the body bore and oriented in a closed position to close the bore depending upon positioning of said member.

5. The downhole tool of claim 4 wherein said member orients said ball between said open ad closed positions by rotating said ball.

6. The downhole tool of claim 6 wherein said ball is biased toward said open position.

7. A downhole tool comprising:

a body;

a first member axially movable relative to the body in a first direction from a first position in response to an applied force;

a second member movable in an opposite second direction;

a ratchet assembly between the first and second members and permitting the movement of the first member in said first direction without corresponding movement of the second member in said first direction, and coupling the first member to the second member when the first member is moved in said second direction; and means for biasing the first member in said second direction towards said first position, movement of the first member in the first direction being translatable to subsequent corresponding movement of the second member in the second direction.

8. The downhole tool of claim 7 wherein said second member operates a valve within said downhole tool.

9. The downhole tool of claim 8 wherein said valve is a ball-valve comprising:

a body defining a bore;

a valve ball defining a through passage such that the ball may be oriented to an open position to permit flow through the body bore and oriented in a closed position to close the bore depending upon positioning of said second member.

10. The downhole tool of claim 9 wherein said second member orients said ball between said open and closed positions by cooperatively rotating said ball.

11. The downhole tool of claim 10 wherein said ball is biased toward said open position.

* * * * *

UNITED STATES PATENT AND TRADEMARK OFFICE

CERTIFICATE OF CORRECTION

PATENT NO. : 6,223,824 B1
APPLICATION NO. : 09/202632
DATED : December 17, 1998
INVENTOR(S) : Peter Barnes Moyes It is certified that error appears in the above-identified patent and that said Letters Patent is hereby corrected as shown below:

<u>In the Claims section</u>:

In column 8, Claim 5, line 13, please delete “ad” and insert --and--.

In column 8, Claim 6, line 15, after the word “claim,” please delete “6” and insert --5--.

Signed and Sealed this

Twenty-seventh Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 6,223,824 B1
APPLICATION NO. : 09/202632
DATED : May 1, 2001
INVENTOR(S) : Peter Barnes Moyes It is certified that error appears in the above-identified patent and that said Letters Patent is hereby corrected as shown below:

In the Claims section:

In column 8, Claim 5, line 13, please delete “ad” and insert --and--.

In column 8, Claim 6, line 15, after the word “claim,” please delete “6” and insert --5--.

This certificate supersedes Certificate of Correction issued February 27, 2007.

Signed and Sealed this

Twenty-seventh Day of March, 2007

JON W. DUDAS
*Director of the United States Patent and Trademark Office*